US010813402B2

(12) United States Patent
Posner et al.

(10) Patent No.: US 10,813,402 B2
(45) Date of Patent: Oct. 27, 2020

(54) PROTECTIVE HELMETS INCLUDING NON-LINEARLY DEFORMING ELEMENTS

(71) Applicants: University of Washington, Seattle, WA (US); Vicis, Inc., Seattle, WA (US)

(72) Inventors: Jonathan D. Posner, Seattle, WA (US); John T. Dardis, II, Seattle, WA (US); Paul C. Leonard, Woodinville, WA (US); Per G. Reinhall, Seattle, WA (US)

(73) Assignees: University of Washington, Seattle, WA (US); VPG Acquisition Co, LLC, New York, NY (US)

( * ) Notice: Subject to any disclaimer, the term of this patent is extended or adjusted under 35 U.S.C. 154(b) by 333 days.

(21) Appl. No.: 15/078,848

(22) Filed: Mar. 23, 2016

(65) Prior Publication Data

US 2016/0278470 A1 Sep. 29, 2016

Related U.S. Application Data

(60) Provisional application No. 62/136,969, filed on Mar. 23, 2015.

(51) Int. Cl.
*A42B 3/12* (2006.01)
*A42B 3/06* (2006.01)

(52) U.S. Cl.
CPC ..... *A42B 3/124* (2013.01); *A42B 3/064* (2013.01)

(58) Field of Classification Search
CPC ..... A42B 3/20; A42B 3/124; A42B 3/127; A42B 3/064; A63B 33/00
USPC ..... 2/411, 410, 413, 414, 421, 455, 412
See application file for complete search history.

(56) References Cited

U.S. PATENT DOCUMENTS 3,344,433 A 10/1967 Stapenhill
3,877,076 A * 4/1975 Summers ..... A42B 3/065 2/414
4,012,794 A 3/1977 Nomiyama
4,307,471 A 12/1981 Lovell
(Continued)

FOREIGN PATENT DOCUMENTS

CN 1543318 A 11/2004
CN 104219975 A 12/2014
(Continued)

OTHER PUBLICATIONS

Canadian Office Action, Canadian Application No. 2,928,241, dated Nov. 27, 2017, 4 pages.
(Continued)

*Primary Examiner* — Katherine M Moran
(74) *Attorney, Agent, or Firm* — Christensen O'Connor Johnson Kindness PLLC

(57) ABSTRACT

A protective helmet comprises an inner layer and an outer layer separated from the inner layer by a space. An interface layer is positioned in the space between the inner layer and the outer layer and includes an impact absorbing material that non-linearly deforms in response to an incident force on the protective helmet. For example, the impact absorbing material includes multiple filaments each having an end proximate to the inner layer and another end proximate to the outer layer interface, with the filaments configured to non-linearly deform in response to an incident force on the helmet.

18 Claims, 9 Drawing Sheets

(56) References Cited

U.S. PATENT DOCUMENTS

| | | | | |
|---|---|---|---|---|
| 5,504,945 | A * | 4/1996 | Purnell | A63B 71/10 2/209 |
| 5,956,777 | A | 9/1999 | Popovich | |
| 6,658,671 | B1 | 12/2003 | Von Hoist et al. | |
| 7,089,602 | B2 * | 8/2006 | Talluri | A42B 3/063 2/411 |
| 7,328,462 | B1 | 2/2008 | Straus | |
| 8,046,845 | B1 * | 11/2011 | Garcia | A42B 3/061 2/2.5 |
| 8,087,101 | B2 | 1/2012 | Ferguson | |
| 8,578,520 | B2 | 11/2013 | Halldin | |
| 8,756,719 | B2 * | 6/2014 | Veazie | A42B 3/121 2/411 |
| 8,776,272 | B1 * | 7/2014 | Straus | A42B 3/003 2/411 |
| 9,462,842 | B2 | 10/2016 | Hoshizaki et al. | |
| 9,516,910 | B2 | 12/2016 | Szalkowski et al. | |
| 2004/0117896 | A1 | 6/2004 | Madey et al. | |
| 2007/0209098 | A1 * | 9/2007 | Peart | A42B 3/124 2/410 |
| 2008/0155735 | A1 | 7/2008 | Ferrara | |
| 2011/0143080 | A1 | 6/2011 | Ortiz et al. | |
| 2012/0017358 | A1 | 1/2012 | Princip et al. | |
| 2012/0096631 | A1 | 4/2012 | King et al. | |
| 2012/0297526 | A1 | 11/2012 | Leon | |
| 2012/0306120 | A1 | 12/2012 | Li et al. | |
| 2013/0000015 | A1 | 1/2013 | Marzec et al. | |
| 2013/0000017 | A1 | 1/2013 | Szalkowski et al. | |
| 2013/0019385 | A1 | 1/2013 | Knight et al. | |
| 2013/0040524 | A1 | 2/2013 | Halldin et al. | |
| 2013/0061371 | A1 | 3/2013 | Phipps et al. | |
| 2013/0122256 | A1 | 5/2013 | Kleiven et al. | |
| 2013/0185837 | A1 | 7/2013 | Phipps et al. | |
| 2013/0330502 | A1 | 12/2013 | Lewis et al. | |
| 2014/0013492 | A1 | 1/2014 | Bottlang et al. | |
| 2014/0109299 | A1 * | 4/2014 | Kwan | A41D 13/015 2/413 |
| 2014/0196198 | A1 | 7/2014 | Cohen | |
| 2014/0223641 | A1 * | 8/2014 | Henderson | A42B 3/065 2/411 |
| 2015/0223547 | A1 | 8/2015 | Wibby | |
| 2015/0282550 | A1 * | 10/2015 | Musal | A42B 3/06 2/414 |
| 2017/0273387 | A1 * | 9/2017 | Sicking | A42B 3/064 |

FOREIGN PATENT DOCUMENTS

| | | | |
|---|---|---|---|
| CN | 104427896 | A | 3/2015 |
| GB | 1578351 | A | 11/1980 |
| JP | 2007-254920 | A | 4/2007 |
| WO | WO 2013/079989 | A1 | 6/2013 |
| WO | WO 2015/069800 | A2 | 5/2015 |
| WO | 2015089646 | A1 | 6/2015 |

OTHER PUBLICATIONS

Chinese First Office Action, Chinese Application No. 201480060473.9, dated Jun. 28, 2017, 15 pages.

Chinese Second Office Action, Chinese Application No. 201480060473.9, dated Jan. 31, 2018, 15 pages (with concise explanation of relevance).

European Extended Search Report, European Application No. 14861065.2, dated Sep. 11, 2017, 7 pages.

PCT International Search Report and Written Opinion, PCT Application No. PCT/US2016/023847, dated Jun. 7, 2016, 14 pages.

PCT International Search Report, PCT Application No. PCT/US14/64173, dated Apr. 8, 2015, 5 pages.

"MIPS | Patented Brain Protection System," MIPS AB, undated, [Online] [Retrieved on Aug. 1, 2016] Retrieved from the Internet<URL:http://www.mpsprotection.com/>.

POC: Crane Mips Helmets, POC Sweden AB, 2 pagea, undated, [Online] [Retrieved on Aug. 2, 2016] Retrieved from the Internet<URL:http://www.pocsports.com/en/content/view/new-technologies>.

Canadian First Office Action, Canadian Application No. 2,928,241, dated Feb. 9, 2017, 4 pages.

Supplementary Partial European Search Report dated Nov. 9, 2018, filed in corresponding European Application No. 16769643A, filed Mar. 23, 2016, 11 pages.

Non-Final Office Action dated Sep. 26, 2018, in corresponding Canadian Application No. 2,928,241, filed Nov. 5, 2014, 4 pages.

Third Office Action, dated Jul. 26, 2018, issued in corresponding Chinese Application No. 201480060473.9, filed Nov. 5, 2014, 16 pages.

Rejection Decision dated Feb. 13, 2019, issued in corresponding Chinese Application No. 201480060473.9, filed Nov. 5, 2019, 25 pages.

Extended European Search Report dated Feb. 20, 2019, issued in corresponding European Application No. 16769643.4, filed Mar. 23, 2016, 10 pages.

Official Notice of Rejection dated Dec. 4, 2018, issued in corresponding Japanese Application No. 2016-552473, filed Nov. 5, 2014, 21 pages.

Communication Pursuant to Article 94(3) EPC dated Mar. 25, 2019, issued in corresponding European Application No. 148610652, filed Nov. 5, 2014, 7 pages.

Office Action for Japanese Patent Application No. 2016-552473, dated Jul. 30, 2019. (with English Translation, 18 pages).

Communication Pursuant to Article 94(3) EPC, dated Oct. 8, 2019, for European Patent Application 14861065.2. (6 pages).

Communication Pursuant to Article 94(3) EPC, dated Dec. 19, 2019, for European Patent Application No. 16769643.4. (4 pages).

Office Action, dated Jan. 6, 2020, for Chinese Patent Application No. 201680017406.8. (10 pages).

* cited by examiner

PROTECTIVE HELMETS INCLUDING NON-LINEARLY DEFORMING ELEMENTS

CROSS REFERENCE TO RELATED APPLICATIONS

This application claims the benefit of U.S. Provisional Application No. 62/136,969, filed Mar. 23, 2015, which is incorporated by reference in its entirety.

BACKGROUND

The present technology is generally related to protective helmets, and more specifically to protective helmets including non-linearly deforming elements.

Sports-related traumatic brain injury, and specifically concussions, have become major concerns football teams and leagues at various levels, from high school to professional. Such injuries are also significant concerns for participants in other activities such as cycling and skiing. Current helmet technology inadequately protects wearers from concussions, as current helmets primarily protect wearers from superficial head injury rather than concussions that can be caused by direct or oblique forces. Additionally, most conventional helmets linearly absorb incident forces, which transmits the bulk of the incident force to a wearer's head.

SUMMARY

A protective helmet comprises an inner layer and an outer layer separated from the inner layer by a space. An interface layer is positioned in the space between the inner layer and the outer layer and includes an impact absorbing material that non-linearly deforms in response to an incident force on the protective helmet. For example, the impact absorbing material includes multiple filaments each having an end proximate to the inner layer and another end proximate to the outer layer interface, with the filaments configured to non-linearly deform in response to an incident force on the helmet. In some embodiments, the impact absorbing material allows the helmet to locally and elastically deform in response to an incident force. Varying the composition, number, and configuration of the filaments in the impact absorbing material or varying composition and configuration of the outer layer or of the inner layer allows deformation of the helmet to be customized for different implementations. For example, filaments in the impact absorbing material have different shapes or comprise different materials in different embodiments to customize deformation of the helmet.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure.

DETAILED DESCRIPTION

Figure 1A:
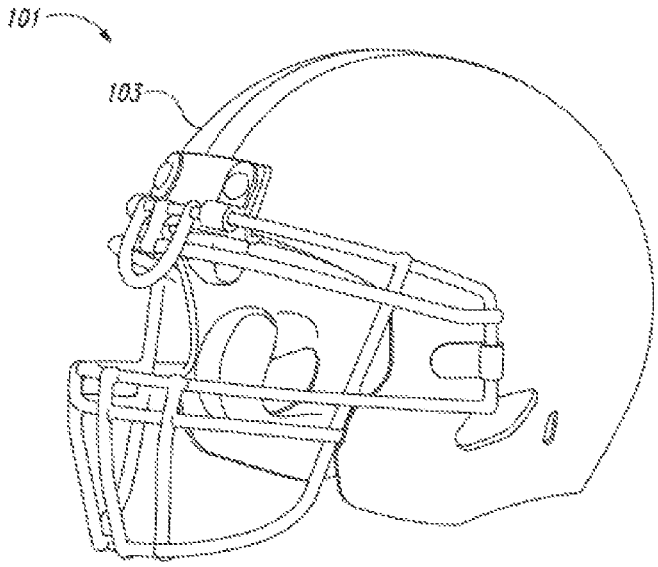
FIG. 1A is a perspective view of a protective helmet, in accordance with an embodiment.
Figure 1B:
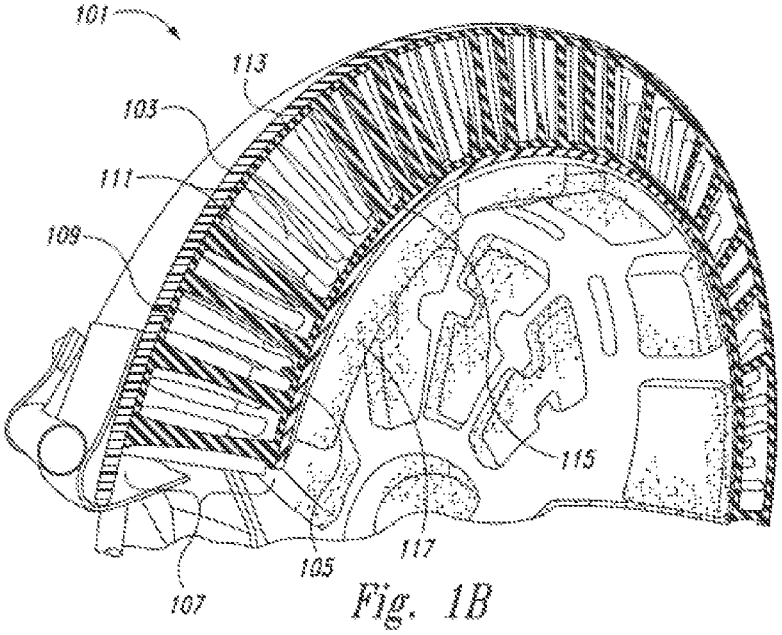
FIG. 1B is a perspective cross-sectional view of a protective helmet, in accordance with an embodiment.

Protective Helmets Having an Interface Layer Between an Inner Layer and an Outer Layer FIG. 1A is a perspective view of an embodiment of a protective helmet 101, and FIG. 1B is a perspective cross-sectional view of the protective helmet 101. In the embodiment shown by FIGS. 1A and 1B, the helmet 101 comprises an outer layer 103, an inner layer 105, and a space 107 between the outer layer 103 and the inner layer 105. An interface layer 109 comprising a plurality of filaments 111 is disposed in the space 107 between the outer layer 103 and the inner layer 105. In the illustrated embodiment, the filaments 111 extend between an outer surface 113 adjacent to the outer layer 103 and an inner surface 115 adjacent to the inner layer 105, and span at least a threshold amount of the space 107. However, in certain embodiments, the helmet 101 does not have an outer layer 103, so the filaments 110, or other non-linear compression units further described below in conjunction with FIGS. 2A-3D, extend from the inner layer 105. Padding 117 is disposed adjacent to an interior surface of the inner layer 105, and may be configured to comfortably conform to a head of a wearer (not shown) of the helmet 101.

In some embodiments, the outer layer 103 of the helmet 101 is a single, continuous shell. However, the outer layer 103 may have a different configuration in other embodiments. The outer layer 103 and the inner layer 105 may both comprise a hard plastic material to provide a measure of rigidity to the outer layer 103 and to the inner layer 105. However, the outer layer 103 is pliable enough to locally deform when subject to an incident force. In certain embodiments, the inner layer 105 is relatively stiffer than the outer layer to prevent projectiles or intense impacts from fracturing the skull or creating hematomas. In some embodiments, the inner layer 105 is at least five times more rigid than the outer layer 103. The outer layer 103 may also comprise a plurality of deformable beams that are flexibly connected and arranged so that the longitudinal axes of the beams are parallel to a surface of the outer layer 103. In some embodiments each of the deformable beams is flexibly connected to at least one other deformable beam and to at least one filament 111.

The filaments 111 comprise thin, columnar or elongated structures that are configured to non-linearly deform in response to an incident force on the helmet 101. Such structures can have a high aspect ratio. For example, an aspect ratio of a filament 110 is between 3:1 and 1000:1. Non-linear deformation of the filaments 111 to provide improved protection against high-impact forces directly incident on the helmet 101, as well as high-impact forces obliquely incident on the helmet 101. More specifically, a filament 111 is configured to buckle in response to an incident force, where buckling is characterized by a sudden failure of the filament 111 when subjected to high compressive stress; the filament 111 fails when the filament 110 is subjected to compressive stress less than the maximum compressive stress that a material comprising the filament 111 is capable of withstanding. The filaments 111 may be configured to elastically deform, so a filament 111 returns to its initial configuration (or substantially returns to its initial configuration) when the compressive stress applied to the filament 110 is removed.

At least a set of the filaments 111 may be configured with a tensile strength that resists separation of the outer layer 103 from the inner layer 105. For example, during lateral movement of the outer layer 103 relative to the inner layer 105, filaments 111 having tensile strength exert force to counteract the lateral movement of the outer layer 103 relative to the inner layer 105. In some embodiments, wires, rubber bands, or other elements are embedded in or otherwise coupled to the filaments 111 to provide additional tensile strength.

As shown in FIG. 1B, the filaments 111 may be directly attached to the outer layer 103 or directly attached to the inner layer 105. In some embodiments, at least some of the filaments 111 are free at one end, with an opposite end coupled to an adjacent surface. For example, an end of a filament 111 is coupled to a surface of the outer layer 105 while an opposite end of the filament 111 is free. As another example, an end of a filament 111 is coupled to a surface of the inner layer 105, while an opposite end of the filament 111 is free. The flexibility of the filaments 111 allows the outer layer 103 to move laterally relative to the inner layer 105. In some embodiments, the filaments 111 optionally include a rotating member at one end or at both ends that is configured to rotatably fit within a corresponding socket in the outer layer 103 or the inner layer 105 to couple a filament 111 to the outer layer 103 or to the inner layer 105. In some embodiments, at least some of the filaments 111 are perpendicular (or substantially perpendicular) to the inner surface 115, to the outer surface 113, or to the inner surface 115 and to the outer surface 113.

Various materials may comprise the filaments 111 in different embodiments. Example materials comprising a filament include: foam, elastomeric material, polymeric material, or any combination thereof. In some embodiments, the filaments 111 may comprise a material having a shape memory material or a self-healing material. Furthermore, in some embodiments, a filament 111 may exhibit different shear characteristics in different directions.

In some embodiments, the helmet 101 is configured to deform locally and elastically in response to an incident force. For example, when between approximately 100 and 500 static pounds of force are applied to the helmet 101, the outer layer 103 and the interface layer 109 deform between about 0.75 and 2.25 inches. Varying the composition, number, and configuration of the filaments 111 or varying the composition and configuration of the outer layer 103 and inner layer 105 allows the deformability of the helmet 101 to be tuned for various embodiments.

Figure 2A:
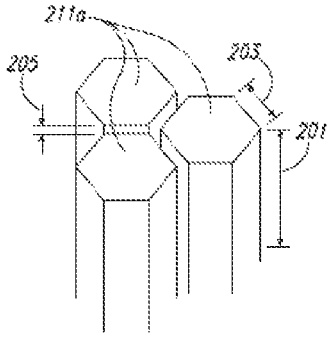
FIGS. 2A-C illustrate various embodiments of filaments configured for an interface layer of a protective helmet, in accordance with an embodiment.
Figure 2B:
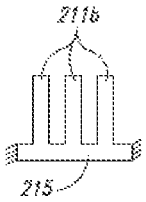
Figure 2C:
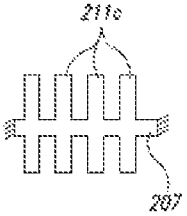

FIGS. 2A-2C illustrate various embodiments of filaments configured for an interface layer 109 of a helmet 101. Referring to FIG. 2A, a plurality of filaments 211*a* have a cross-sectional shape of regular polygons. Individual filaments 211*a* have a height 201, a width 203, and a spacing 205 between adjacent filaments 211*a*. FIG. 2B shows filaments 211*b* having an end connected to an inner surface 215 and another end that is free. In FIG. 2C, a portion of one or more filaments 211*c* (e.g., a middle portion of the one or more filaments 211*c*) is coupled to a spine 207 so ends of a filament 211*c* extends outwardly in opposite directions from the spine 207. As shown by FIGS. 2A-2C, filaments 211*a*-211*c* may have any suitable shape, including cylinders, hexagons (inverse honeycomb), square, irregular polygons, random, etc. Additionally, a point of connection between a filament 211*a*-211*c* and the inner surface 215 or the spine 207 may be modified to customize or modify orthotropic properties of the filaments 211*a*-211*c*. Similarly, one or more of the height 210, the width 203, and the spacing 205 of filaments 211*a*-211*c*, one or more materials comprising the filaments 211*a*-211*c*, or a material in spaces between the filaments 211*a*-211*c*, may be modified to customize orthotropic properties of the filaments 211*a*-211*c*. This customization allows deformation properties of the filaments 211*a*-211*c* to be varied between different regions of the interface layer 109, allowing different regions of the interface layer 109 to have desired deformation properties. The filaments 211*a*-211*c* may be made from any material allowing large elastic deformations including. Example materials for making the filaments 211*a*-211*c* include foams, elastic foams, plastics, etc. Additionally, spacing between filaments 211*a*-211*c* may be filled with gas, liquid, or complex fluids, to further customize overall material properties of the interface layer 109. For example, space between filaments 211*a*-211*c* may be filled with a gas, a liquid (e.g., a shear thinning or shear thickening liquid), a gel (e.g., a shear thinning or shear thickening gel), a foam, a polymeric material, or any combination thereof.

Figure 3A:
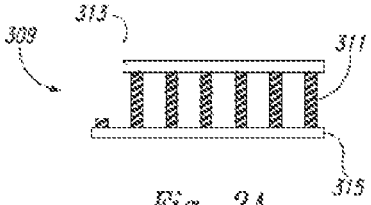
FIGS. 3A-D illustrate deformation of portion of an interface layer of a protective helmet, in accordance with an embodiment.
Figure 3B:
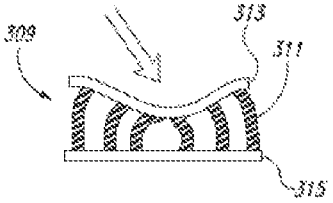
Figure 3C:
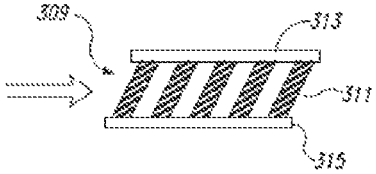
Figure 3D:
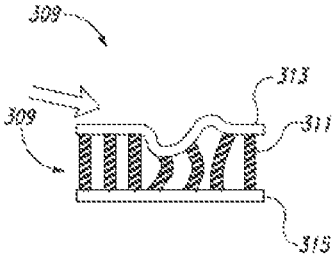

FIGS. 3A-3D illustrate deformation of an interface layer 309 having an outer surface 313, an inner surface 315, and a plurality of filaments 311 extending between the outer surface 313 and the inner surface 315. FIG. 3A illustrates the interface layer 309 without application of an external force. In FIG. 3B, a downward force is applied to the outer surface 313, causing deformation of a portion of the filaments 311. FIG. 3C illustrates translation of the outer surface 313 with respect to the inner surface 315 in response to a tangential force. In FIG. 3D, a vertical and tangential force applied to the outer surface 313 deforms the filaments 311. Oblique or tangential forces t distributed over a larger area of the outer surface 313 may result in shear of the filaments 311 or local buckling of some of the filaments 311.

Figure 4C:
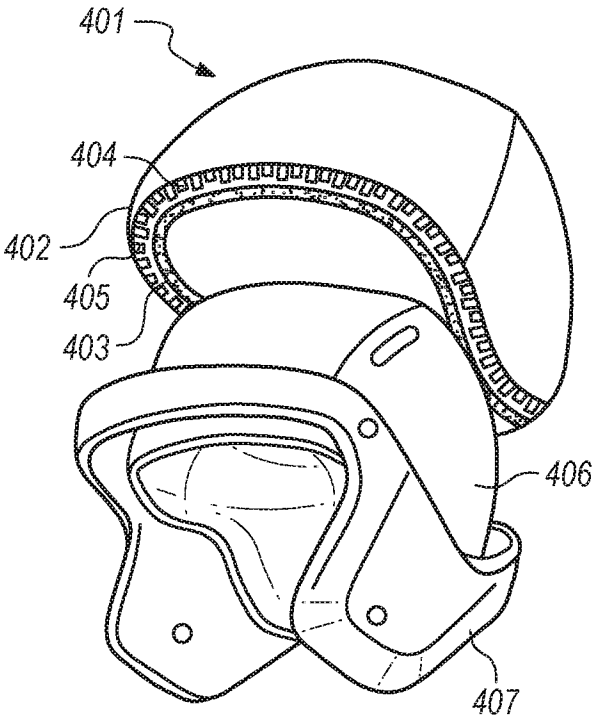
FIG. 4C is an exploded isometric view of a protective helmet, in accordance with an embodiment.
Figure 4B:
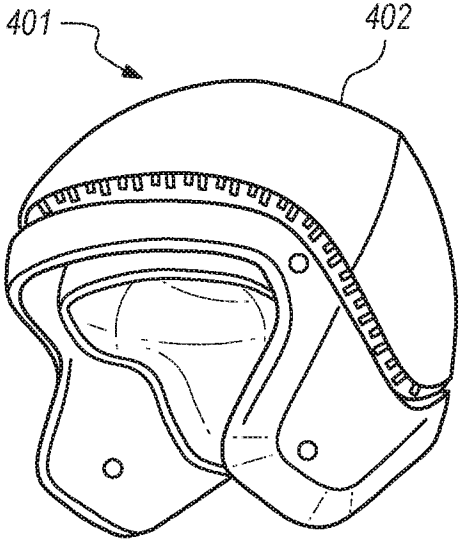
FIG. 4B is an isometric view of a protective helmet, in accordance with an embodiment.
Figure 4A:
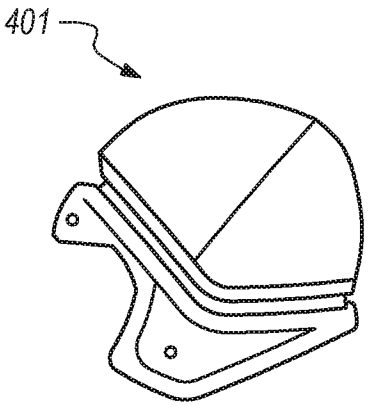
FIG. 4A is a side view of a protective helmet, in accordance with an embodiment.

In certain embodiments, a protective helmet comprises a compression unit removably affixed to an inner layer, allowing the compression unit to be reconditioned or replaced as necessary for safety and comfort. FIG. 4A illustrates a side view of one embodiment of a protective helmet 401. FIG. 4B illustrates an isometric view of the protective helmet 401, while FIG. 4C illustrates isometric exploded view of the protective helmet 401. Referring to FIGS. 4A-4C, the protective helmet 401 comprises: an inner shell 406 that may be sized and shaped to conform a head of a wearer and a compression unit 402 removably affixed to the inner shell 406. The inner shell 406 comprises an inner layer 403, an outer layer 404 separated from the inner layer 403 by a space, and an interface layer 405 positioned in the space between the inner layer 403 and the outer layer 405. The interface layer 405 comprises an impact absorbing material, which may be the plurality of filaments 111 further described above in conjunction with FIGS. 1-3D. The compression unit 402 can be affixed to the inner layer by any device or technique capable of removably coupling the compression unit 402 to the inner layer 403. Example devices for removably coupling the compression unit 402 to the inner layer 403 include: include screws, hook and loop closures, adhesives, and the like.

In some embodiments, the protective helmet further comprises a frame 407 affixed to the inner shell 406. The frame 407 may provide additional structural rigidity to the helmet 401. In certain embodiments, the frame 407 is configured to accept and secure a face mask or face guard to protect a face of the wearer's face.

Figure 9:
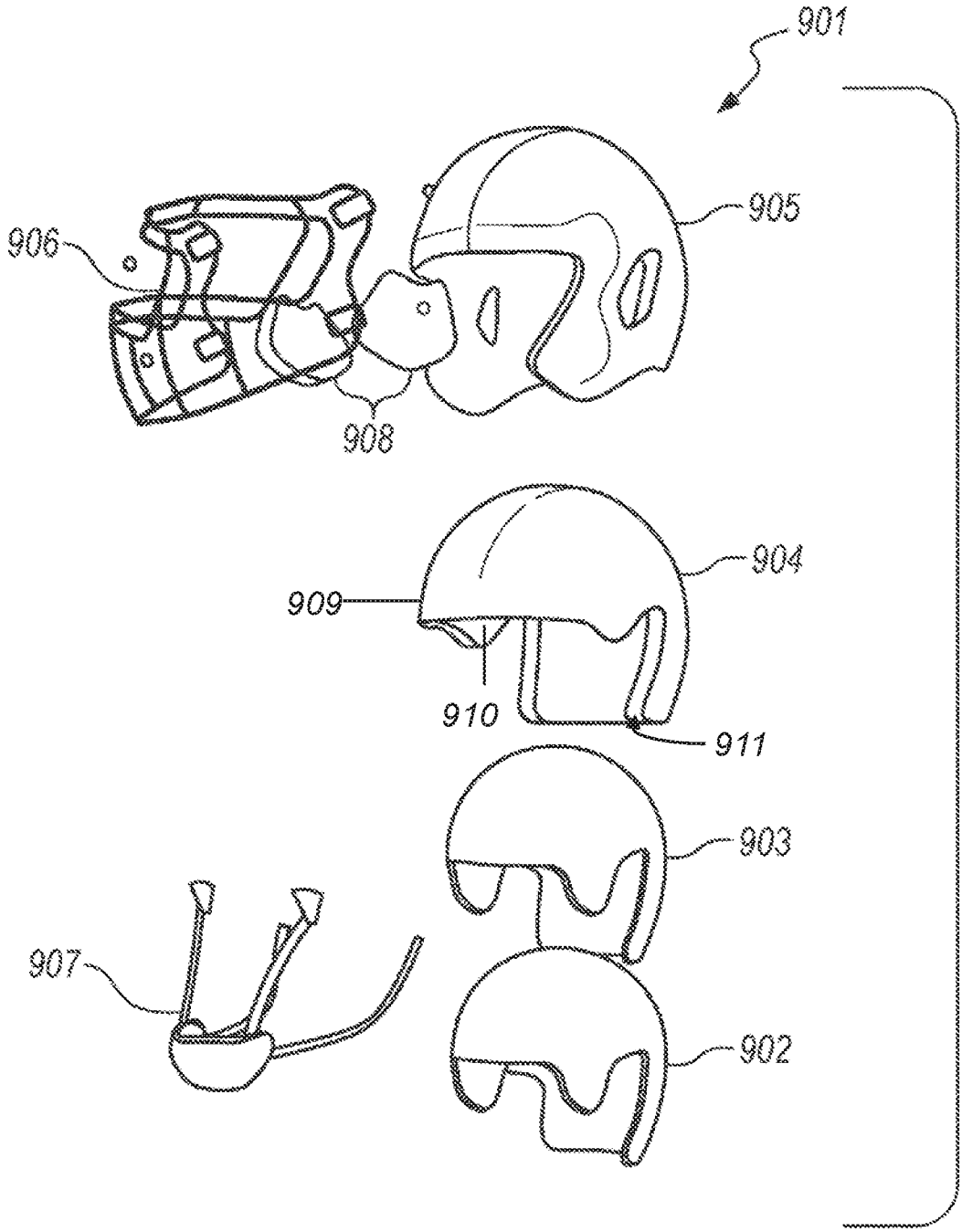
FIG. 9 is an exploded view of a protective helmet, in accordance with an embodiment.

FIG. 9 is an exploded view of an embodiment of a protective helmet 901. In the embodiment shown by FIG. 9, the protective helmet 901 comprises an inner shell 903 sized and shaped to conform the head of a wearer, a compression unit 904 removably affixed to the inner shell, and an outer layer or shell 905. The compression unit 904 positioned between the inner shell 903 and outer layer or shell 905. The compression unit 904 comprises an impact absorbing material or a plurality of impact absorbers. The compression unit 904 further comprises an outer layer 909, an inner layer 910, and an interface layer 911. The outer layer 909 separated from the inner layer 910 by a space. The interface layer 911 disposed in the space and comprises an impact absorbing material or a plurality of impact absorbers. Padding 902 is disposed adjacent to the inner layer 903, and the padding 902 may be configured to comfortably conform to a head of the wearer. In some embodiments, the protective helmet 901 further comprises a facemask 906 affixed to the outer layer 905 and a chin strap 907 affixed to the inner layer. In certain embodiments, the protective helmet 901 also includes pads 908 configured to contact and conform to the cheeks of a wearer to comfortably secure the protective helmet 901 to the head of the wearer.

Interface Layer Configuration

In certain embodiments, a protective helmet comprises an interface layer between an inner layer and an outer layer, the interface layer comprises multiple layers of individual impact absorbers. Such an interface layer provides a non-linear force displacement curve that optimally absorbs impact and reduces peak acceleration at impact, which spreads an impact to the helmet and head of a wearer over a longer period of time. In various embodiments, an interface layer comprises one or more intermediate layers and multiple, stacked pluralities of filaments with different mechanical properties, compositions, and geometries to provide the non-linear force displacement curve. For example, each plurality of filaments has a different stiffness and deforms non-linearly in response to varying levels of incident force.

Figure 5:
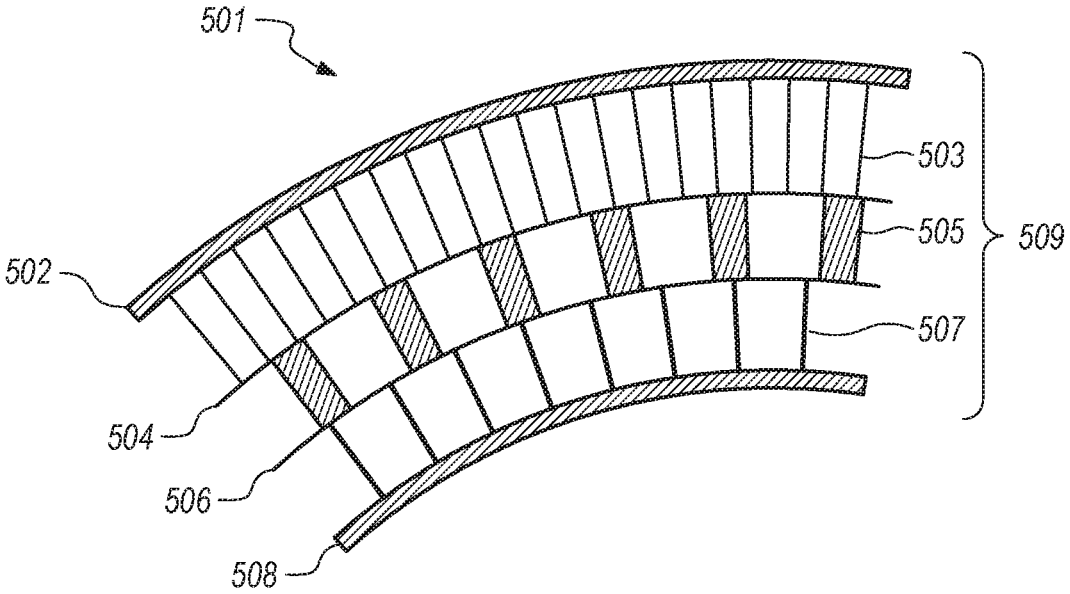
FIG. 5 is a cross-sectional view of an interface layer and impact absorbing materials in a protective helmet, in accordance with an embodiment.

FIG. 5 illustrates a cross-section of a compression unit 501. In the example shown by FIG. 5, the compression unit 501 comprises an inner layer 508, an outer layer 502 positioned apart from the inner layer 508 to define a space between the inner layer 508 and outer layer 502, and an interface layer 509 positioned in the space between the inner layer 508 and the outer layer 502 and comprising an impact absorbing material. In this embodiment, the interface layer 509 comprises a plurality of filaments 503 that each comprise an end proximate to the outer layer 502 and an additional end proximate to an intermediate layer 504, an additional plurality of filaments 505 that each comprise an end proximate to an additional intermediate layer 506 and an additional end proximate to the inner layer 508. Additionally, the interface layer 503 comprises another plurality 507 of filaments positioned between the plurality of filaments 503 and the additional plurality of filaments 505, with each filament of the other plurality 507 of filaments having an end proximate to the intermediate layer 504 and an additional end proximate to the additional intermediate layer 506. The filaments of the plurality of filaments 503, the additional plurality of filaments 505, and the other plurality of filaments 507 are configured to non-linearly deform in response to an external incident force on the compression unit 501. As shown in FIG. 5, filaments of the plurality of filaments 503, the additional plurality of filaments 505, and the other plurality of filaments 507 may have different diameters, which may provide different stiffnesses and/or buckling strengths. In certain embodiments, different pluralities of filaments have varying geometries and materials, as described in, for example, PCT application no. PCT/US2014/064173, filed on Nov. 5, 2014, which is incorporated by reference herein in its entirety. While FIG. 5 shows an example compression unit 501 including three plurality of filaments, in various embodiments, the interface layer 509 may have any number of plurality of filaments that may have their own intermediate layers.

Figure 6:
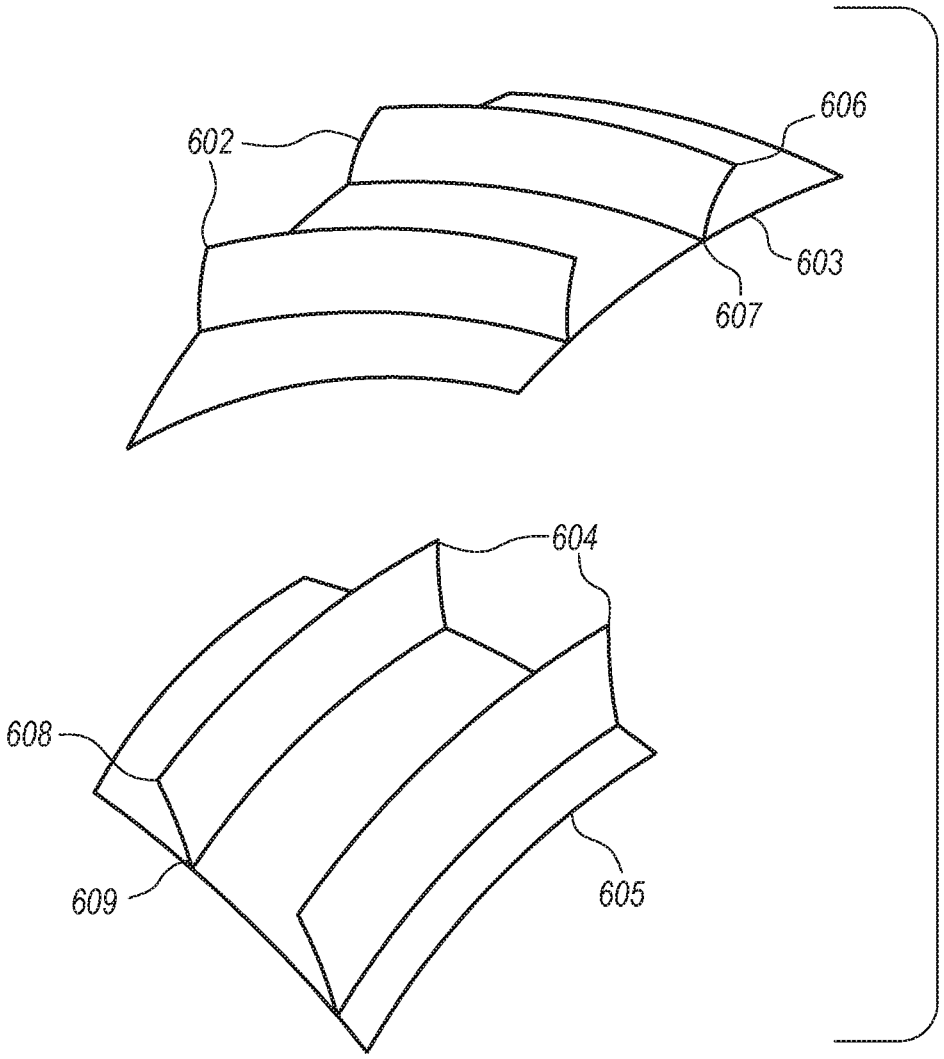
FIG. 6 is a perspective view of an interface layer and impact absorbing materials in a protective helmet, in accordance with an embodiment.

In certain embodiments, protective helmets or compression units comprise a plurality of ribs. For example, the interface layer comprises plurality of ribs, where individual ribs comprise a sheet having a first edge proximate to an inner layer, a second edge proximal to an intermediate layer, and a longitudinal axis. FIG. 6 is an exploded isometric view of the interface layer of a protective helmet or compression unit. In the example of FIG. 6, the interface layer comprises a plurality of ribs 604, with individual ribs comprising a sheet having an edge 609 proximate to an inner layer 605, an additional edge 608 proximate to an intermediate layer 603, and a longitudinal axis. The interface layer in the example of FIG. 6 further comprises an additional plurality of parallel ribs 602, with individual ribs comprising an edge 607 proximate to the intermediate layer 603, an additional edge 606 proximate to the outer layer, and a longitudinal axis. A longitudinal axis of at least one rib of the plurality of ribs 604 is not parallel to a longitudinal axis of at least one rib of the additional plurality of parallel ribs 602, and the ribs of the plurality of ribs 604 and or the additional plurality of parallel ribs 602 are configured to non-linearly deform in response to an external incident force on the helmet or on the compression unit. An angle between longitudinal axes of ribs of the plurality of ribs 604 and axes of ribs of the additional plurality of parallel ribs 602 may have any suitable value in different embodiments. For example, the angle between longitudinal axes of ribs of the plurality of ribs 604 and axes of ribs of the additional plurality of parallel ribs 602 may vary between 1-10 degrees, 1-15 degrees, 1-20 degrees, 1-30 degrees, 1-40 degrees, 1-50 degrees, 1-60 degrees, 1-70 degrees, 1-80 degrees, and 1-90 degrees in various embodiments. While FIG. 6 shows an example interface layer including a plurality of ribs 604 and an additional plurality of parallel ribs 602, in various embodiments, the interface layer may include any number of pluralities of ribs (e.g., a single plurality, 2-5 pluralities, 5 or more pluralities, etc.).

In some embodiments, different pluralities of ribs have different geometries, materials, and densities than other pluralities of ribs. For example, in FIG. 6, the plurality of ribs 604 includes ribs having different geometries or made from different material than ribs of the additional plurality of parallel ribs 602. As another example, the plurality of ribs 604 has a greater density of ribs than the additional plurality of parallel ribs 602. Varying the geometries, materials, and densities of a plurality of ribs allows modification of mechanical properties (e.g., stiffness) of the plurality of ribs, allowing different pluralities of ribs to have different mechanical properties, as well as non-linearly deform in response to varying external forces incident on the protective helmet or on the compression unit. Layering such anisotropic layers in the interface layers of a protective helmet or of a compression unit as described above allows the protective helmet or the compression unit to have an overall isotropic absorption behavior.

In a protective helmet or compression unit as further described above in conjunction with FIGS. 1, 4A-4C, and 5, the inner layer distribute forces across a large area to reduce pressure applied to the head of a wearer, protecting the wearer from skull fractures and hematomas. In contrast to conventional helmets, the protective helmets or compression units described herein have inner layers closer to a wearer's skull than, which reduces the distance between the wearer's head and the inner layer compared to conventional helmets. This reduced distance makes it more difficult to determine a shape of the inner layer that comfortable fits a wide range of wearers' heads, particularly when the inner layer is relatively rigid and inflexible. To allow the inner layer of a protective helmet or a compression unit as described herein to better fit wearers' heads, in various embodiments, the inner layer comprises one or more slits. Removing sections of the inner shell allows the shell to more easily flex to adjust to head sizes and shapes of individual wearers (e.g., enlarge) while donning, wearing, and removing the helmet.

Figure 7:
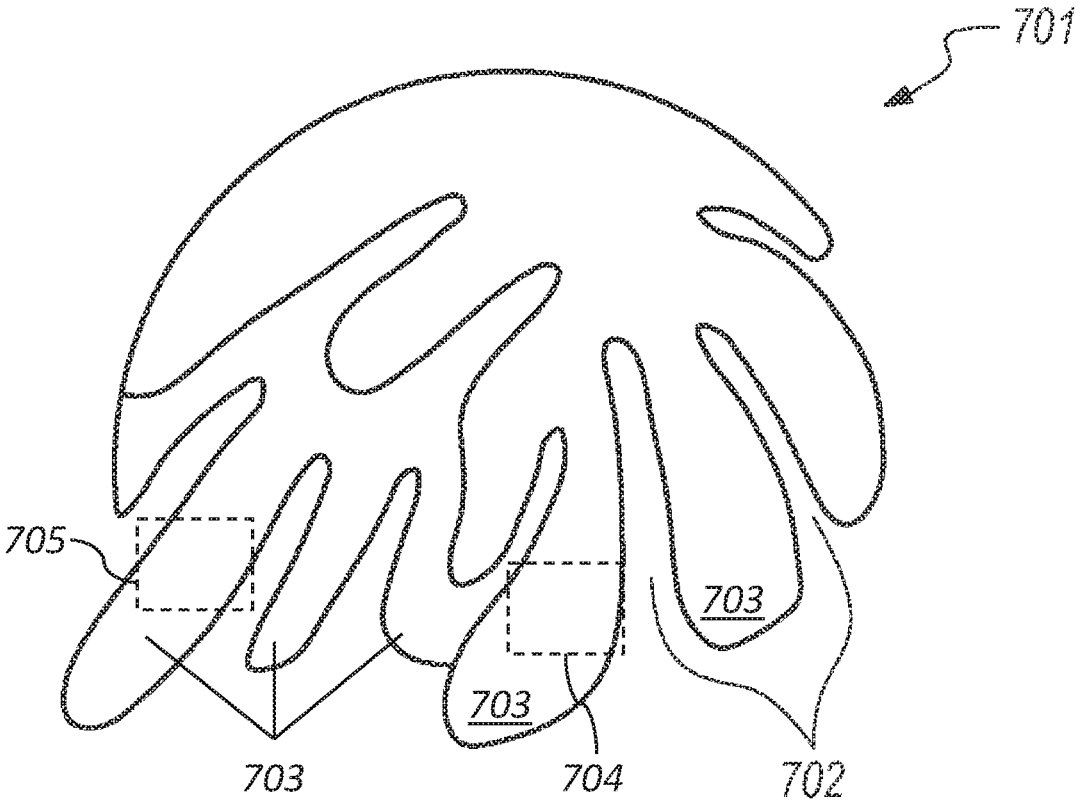
FIG. 7 is a perspective view of an inner layer of a protective helmet, in accordance with an embodiment.
Figure 10:
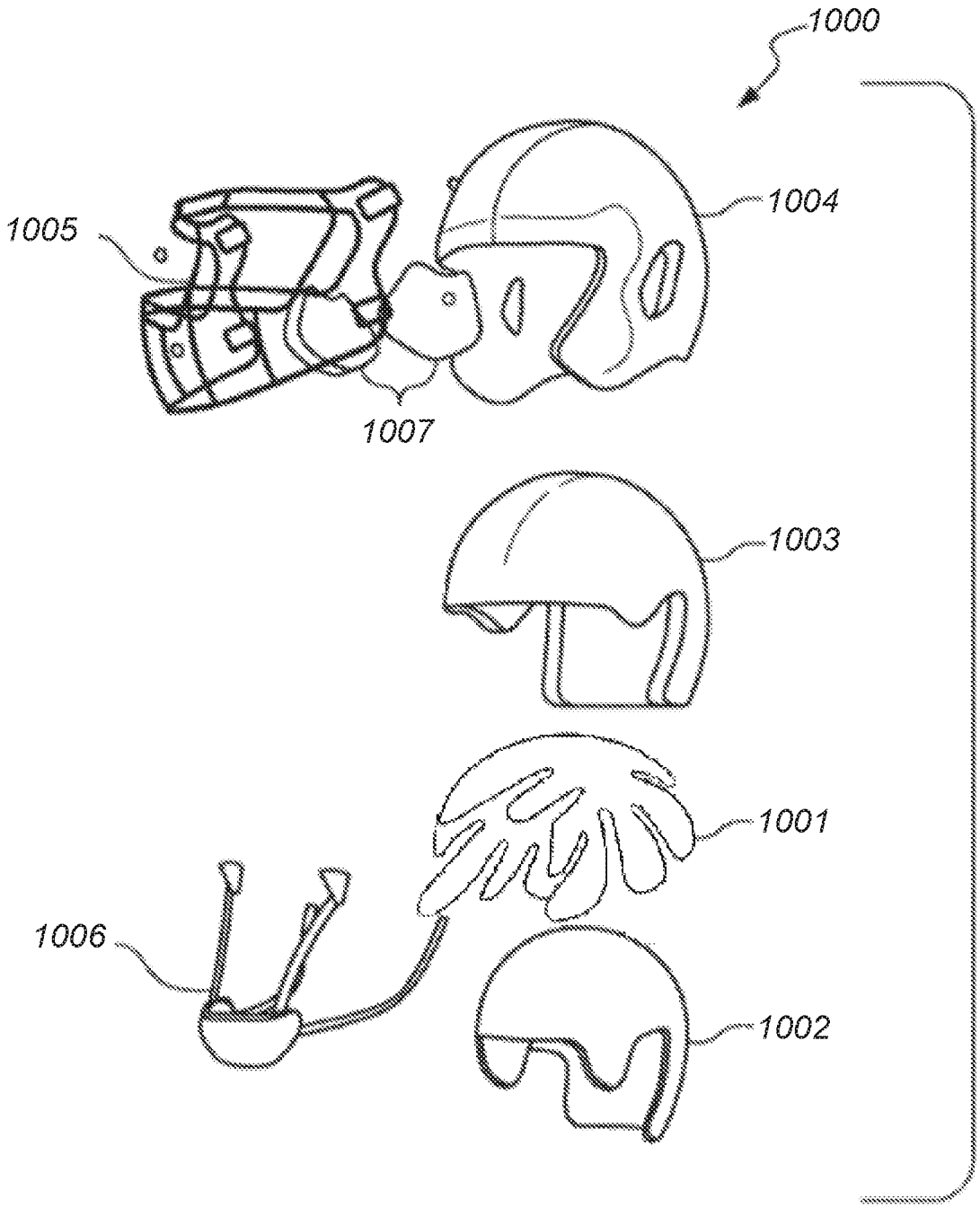
FIG. 10 is an exploded view of a protective helmet having an inner layer of FIG. 7.

FIGS. 7 and 10 illustrates one embodiment of an inner layer of a protective helmet 1000 according to the present technology. The protective helmet 1000 comprises an outer layer 1004, and inner layer 1001, and an interface layer or compression unit 1003. The outer layer 1004 separated by the inner layer 1001 by a space, the interface layer or compression unit 1003 positioned in the space. In the example shown by FIGS. 7 and 10, the inner layer 701,1001 comprises a plurality of slits 702, and one or more inner layer portions 703, which allow the relatively rigid inner shell to flex. The slits 702 may have different widths in different embodiments. Examples widths of the slits 702 include ranges of: 0.1-2 cm, 0.5-1.5 cm, and 0.75-1.25 cm. In certain embodiments, the slits are smaller than the dimensions of, for example, a shoe cleat used in sporting activities. In some embodiments, the protective helmet 1200 further comprises a facemask 1005 affixed to the outer layer 1004 and a chin strap 1006 affixed to the inner layer 701,1001.

In certain further embodiments, the protective helmet including the inner layer 701, which is sized and configured to comfortably and substantially encompass a wearer's head and has the plurality of slits 702 also includes a tightening unit configured to tighten the inner layer 701 to the head of a wearer. The inner layer 701 comprises a tightening unit, a first longitudinal inner layer portion and a second longitudinal inner layer portion having one or more slits 702 between the first and second longitudinal inner layer portions. The tightening unit having a first device 704 and a second device 705, the first device 704 attached to the first longitudinal inner layer portion, the second device 705 being attached to the second longitudinal inner layer portion, the tightening unit is configured to tighten the inner layer 701 to the head of a wearer by manipulating the first and second longitudinal inner layer portions to bring the portions of the first longitudinal inner layer portion and the second longitudinal inner layer portions 703 on either side of a slit 702 in closer proximity to each other by narrowing the width of each of the plurality of slits 702. The tightening unit may be any device 704,705 capable of bringing portions of the inner layer portions 703 on different sides of a slit 702 into closer proximity. Example devices 704,705 used for the tightening unit include: threaded screws, cables, draw strings, flexible bands affixed to either side of the slit 702, a ratchet mechanism, and the like.

In some embodiments, the inner layer of a protective helmet as described herein comprises a relatively stiff or rigid material that does not easily deform in response to an incident force. While having a relatively rigid inner layer protects a wearer by distributing incident forces on the protective helmet, rigidity of the inner layer increases the difficulty of fitting the protective helmet to a broad range of head sizes and shapes. To allow the inner layer to better fit various head sizes and shapes, in some embodiments, the inner layer comprises a thermoplastic material. Example thermoplastic materials include polyurethane, polcaprolactone, polypropylene, polyether block amide, and combinations thereof. A thermoplastic material may be heated to a temperature between a melting temperature and a heat distortion temperature and deformed by application of pressure while at the temperature. When the thermoplastic material is cooled below the heat distortion temperature, deformations of the thermoplastic material are largely maintained by the thermoplastic material. Hence, if the inner layer comprises a thermoplastic material, heating the inner layer to a temperature above a heat distortion temperature of the thermoplastic material and applying pressure to the inner layer allows the inner layer to be individually fit to a wearer's head. For example, after heating the inner layer to a temperature above the heat distortion temperature of a thermoplastic material comprising the inner layer, a protective helmet including the inner layer is placed on a wearer's head to individually fit the inner shell to the wearer's head.

In certain embodiments, an inner layer of a protective helmet as described herein comprises a shell configured to substantially surround a portion of the head of a wearer and a deformable foam cushion disposed and configured to cushion the head of the wearer from incident forces on the helmet. The deformable foam cushion may be a heat-moldable foam in various embodiments. For example, the heat-moldable fold is foam having an elastic modulus that decreases at temperatures above a plastic transition temperature (also referred to as a "softening temperature"). Hence, a heat-moldable foam softens when heated to temperatures above the softening temperature, allowing the heat-moldable foam to be molded at temperatures above the softening temperature. When the heat-moldable foam is cooled to temperatures below the softening temperature, the heat-moldable foam retains a shape to which it was molded while at a temperature above the softening temperature. Protective helmets as described here may further include an additional foam cushion that does not comprise heat-moldable foam and is positioned on an interior surface of a protective helmet and configured to contact a forehead of a wearer of the helmet.

Figure 8:
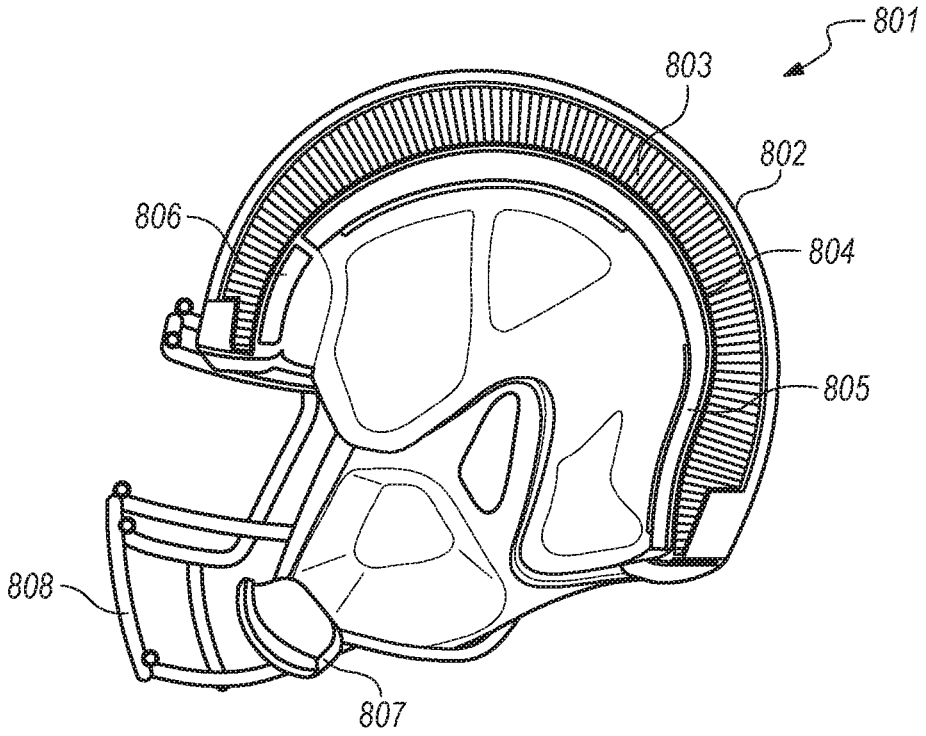
FIG. 8 is a cross-sectional side view of a protective helmet, in accordance with an embodiment.

FIG. 8 is a cross-section of one embodiment of a helmet 801 including an inner layer that comprises a shell 804 configured to substantially surround a portion of the head of a wearer and a deformable foam cushion 805 configured to cushion the head of the wearer from incident forces on the helmet 801. Additionally, the embodiment of the helmet 801 shown in FIG. 8 also includes an outer layer 802 separated from the inner layer by a space and an interface layer 803 positioned in the space between the inner layer and the outer layer 802. The interface layer 803 comprises an impact absorbing material. In the example shown by FIG. 8, the impact absorbing material comprises a plurality of filaments. The helmet 801 may also include a facemask 808 and a chin strap 807, as shown in FIG. 8.

In the embodiment shown by FIG. 8, the helmet 801 also includes additional foam cushion 806 positioned on an interior surface of the helmet 801 and configured to contact a forehead of a user wearing the helmet 801. Unlike the deformable foam cushion 805, the additional foam cushion 806 does not comprise heat-moldable foam. Having foam that is not heat-moldable for the additional foam cushion allows a wearer's forehead to remain at a known reference location, while the helmet 801 accounts for variations in wearers' head size or shape at the rear of the helmet 801 via the heat-moldable foam comprising the foam cushion 805 at the rear and sides of the helmet 801. As side forces on the head of the wearer are generally symmetrical, while the geometry and forces to the front and back of the head of the wearer not typically symmetrical, so when fitting the helmet 801 to a wearer's head, the wearer's head is pushed forward against the additional foam cushion 806 during fitting. This allows a wearer to maintain good visibility from an opening at a front of the helmet 801 by preserving a distance between the wearer's eyes and the front opening of the helmet 801. Alternatively, the additional foam cushion 806 is positioned on an interior surface of the helmet 801 and configured to contact a back of the wearer's head.

To fit a helmet to a wearer's head, a helmet having an interior surface sized and shaped to conform to the head of a wearer is provided. The helmet includes a deformable foam cushion comprising heat-moldable foam positioned on an interior of the helmet. The heat-moldable foam is heated, and the head of the wearer is inserted into the helmet, causing deformation of the heat-moldable foam comprising the deformable foam cushion to fit the helmet to the head of the wearer. The heat-moldable foam is heated using a heating element shaped to conform to the interior surface of the helmet and configured to transfer heat from the heating element to the deformable foam cushion. Hence, a helmet having an interior surface sized and shaped to conform to a wearer's head and having a deformable foam cushion comprising a heat-moldable foam positioned on an interior of the helmet may be fit to the wearer's head by heating the heat-moldable foam using a heating element shaped to conform to the interior surface of the helmet and configured to transfer heat from the heating element to the deformable foam cushion. After heating the heat-moldable foam, the helmet is placed on the wearer's head while the heat-moldable foam is heated. Deformation of the heated heat-moldable foam by the wearer's head fits the helmet to the wearer's head.

SUMMARY

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A helmet comprising:

an outer shell;

an inner shell, the inner shell comprises at least a relatively rigid material;

a compression unit, the compression unit positioned between the outer shell and the inner shell, the compression unit comprising;

an inner layer;

an outer layer separated from the inner layer by a space between the inner layer and outer layer; and an interface layer positioned in the space between the inner layer and the outer layer, the interface layer comprising a plurality of impact absorbers, the plurality of impact absorbers comprising a height and a width, wherein the height is greater than the width; and a foam cushion, the foam cushion including a first portion and a second portion, the foam cushion first portion and the foam cushion second portion are different foams, the foam cushion being positioned on an interior surface of the helmet.

2. The helmet of claim 1, wherein the plurality of impact absorbers comprises a plurality of filaments configured to non-linearly deform in response to an external force incident on the helmet, each of the plurality of filaments having an end proximal to the inner layer and an additional end proximal to the outer layer.

3. The helmet of claim 2, wherein the plurality of filaments comprises a material selected from the group consisting of a foam material, an elastic foam, a polymeric material, an elastomeric material, and any combination thereof.

4. The helmet of claim 2, wherein filaments of the plurality of filaments have an aspect ratio between 3:1 and 1000:1.

5. The helmet of claim 1, wherein the plurality of impact absorbers comprises a plurality of filaments, each of the plurality of filaments having an end proximate to the inner layer and an additional end proximate to an intermediate layer; and an additional plurality of filaments, the additional plurality of filaments comprising each of the additional plurality of filaments having an end proximate to the intermediate layer and an additional end proximate to the outer layer, and the plurality of filaments and the additional plurality of filaments are configured to non-linearly deform in response to an external force incident on the compression unit.

6. The helmet of claim 5, wherein the plurality of impact absorbers further comprises another plurality of filaments positioned between the plurality of filaments and the additional plurality of filaments, each of the other plurality of filaments having an end proximate to the additional ends of one or more filaments of the plurality of filaments and an additional end proximate to the end of one or more filaments of the additional plurality of filaments.

7. The helmet of claim 1, further comprising a frame affixed to the inner shell configured to removably accept a facemask.

8. The helmet of claim 1, wherein the inner shell comprises a thermoplastic material.

9. The helmet of claim 1, wherein the foam cushion first portion or foam cushion second portion comprises a heat-moldable foam.

10. A helmet, comprising:

an inner layer sized and shaped to conform to a head of a wearer, the inner layer includes one or more slits between each one or more longitudinal inner layer portions, the inner layer further comprising a tightening unit, a first longitudinal inner layer portion and a second longitudinal inner layer portion having one or more slits between the first and second longitudinal inner layer portions, the tightening unit having a first device and a second device, the first device attached to the first longitudinal inner layer portion, the second device being attached to the second longitudinal inner layer portion, the tightening unit configured to tighten the inner layer to the head of the wearer by manipulating the first and second devices to bring the first longitudinal inner layer portion in closer proximity with the second longitudinal inner layer portion by narrowing the one or more slits;

an outer layer separated from the inner layer by a space;

an interface layer positioned in the space between the inner layer and the outer layer, the interface layer comprising:

a plurality of filaments, each of the plurality of filaments comprising an end proximate to the inner layer and an additional end proximate to an intermediate layer, the plurality of filaments having a height and a width, wherein the height is greater than the width;

an additional plurality of filaments, each of the additional plurality of filaments comprising an end proximate to the intermediate layer and additional end proximate to the outer layer, at least one of the plurality of filaments and the additional plurality of filaments and configured to non-linearly deform in response to an external force incident to the helmet; and a foam cushion, the foam cushion including a first portion and a second portion, the foam cushion first portion and the foam cushion second portion are different foams, the foam cushion being positioned on an interior surface of the helmet.

11. The helmet of claim 10, wherein the interface layer further comprises another plurality of filaments positioned between the plurality of filaments and the additional plurality of filaments, each of the another plurality of filaments having an end proximate to the intermediate layer and an additional end proximate to an additional intermediate layer.

12. The helmet of claim 10, wherein the plurality of filaments has a different buckling strength than the additional plurality of filaments.

13. The helmet of claim 10, wherein the inner layer comprises a thermoplastic material.

14. A helmet comprising:

an inner layer configured to substantially surround a portion of the head of a wearer, the inner layer having an interior surface and an exterior surface, the inner layer comprising at least a relatively rigid material, the inner layer further comprising a tightening unit, a first longitudinal inner layer portion and a second longitudinal inner layer portion having one or more slits between the first and second longitudinal inner layer portions, the tightening unit having a first device and a second device, the first device attached to the first longitudinal inner layer portion, the second device being attached to the second longitudinal inner layer portion, the tightening unit configured to tighten the inner layer to the head of the wearer by manipulating the first and second devices to bring the first longitudinal inner layer portion in closer proximity with the second longitudinal inner layer portion by narrowing the one or more slits;

a deformable foam cushion, the deformable foam cushion including a first portion and a second portion, the deformable foam cushion first portion and the deformable foam cushion second portion are different foams, the deformable foam cushion being positioned on the interior surface of the inner layer, the deformable foam cushion configured to cushion the head of the wearer from incident forces on the helmet;

an outer layer separated from the inner layer by a space; and an interface layer comprising a plurality of impact absorbers, the plurality of impact absorbers having a height and a width, wherein the height is greater than the width, the interface layer positioned in the space separating the inner layer and the outer layer, the interface layer having an interior surface, the inner layer exterior surface being positioned proximate to the interface layer interior surface.

15. The helmet of claim 14, wherein the deformable foam cushion first portion or foam cushion second portion comprises a heat-moldable foam.

16. The helmet of claim 14, wherein the deformable foam cushion is removably coupled to the interior surface of the inner layer.

17. The helmet of claim 14, wherein the plurality of impact absorbers comprises a plurality of filaments configured to non-linearly deform in response to an external force incident on the helmet, each filament having an end proximal to the inner layer and an additional end proximal to the outer layer.

18. The helmet of claim 17, wherein the plurality of filaments includes the individual filaments comprising an end proximate to the inner layer and an additional end proximate to an intermediate layer; and wherein the plurality of impact absorbers comprises an additional plurality of filaments, the additional plurality of filaments comprising individual filaments having an end proximate to the intermediate layer and an additional end proximate to the outer layer, and the filaments of the additional plurality of filaments configured to non-linearly deform in response to an external force incident on the helmet.

* * * * *